US006218917B1

(12) United States Patent
Criniti et al.

(10) Patent No.: US 6,218,917 B1
(45) Date of Patent: Apr. 17, 2001

(54) METHOD AND ARRANGEMENT FOR CALIBRATION OF CIRCUIT BREAKER THERMAL TRIP UNIT

(75) Inventors: Joseph Criniti, New Britain; Javier I. Larranaga, Bristol, both of CT (US); Volkman Henschel, Nortorf (DE); Manfred Schulz; Walter Felden, both of Neumünster (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/346,586

(22) Filed: Jul. 2, 1999

(51) Int. Cl.[7] ..... H01H 83/00

(52) U.S. Cl. ..... 335/35; 335/23; 335/172; 335/176; 335/45

(58) Field of Search ..... 335/23–25, 31, 335/35, 42, 43, 45, 44, 167–176; 337/36–40, 85, 86, 87, 75, 78, 77

(56) References Cited

U.S. PATENT DOCUMENTS

| | | | |
|---|---|---|---|
| D. 367,265 | | 2/1996 | Yamagata et al. . |
| 2,340,682 | | 2/1944 | Powell . |
| 2,719,203 | | 9/1955 | Gelzheiser et al. . |
| 2,937,254 | | 5/1960 | Ericson . |
| 3,158,717 | | 11/1964 | Jencks et al. . |
| 3,162,739 | | 12/1964 | Klein et al. . |
| 3,197,582 | | 7/1965 | Norden . |
| 3,307,002 | | 2/1967 | Cooper . |
| 3,517,356 | | 6/1970 | Hanarusa . |
| 3,631,369 | | 12/1971 | Menocal . |
| 3,803,455 | | 4/1974 | Willard . |
| 3,849,751 | * | 11/1974 | Link et al. ..... 337/58 |
| 3,883,781 | | 5/1975 | Cotton . |
| 3,908,110 | | 9/1975 | Heft . |
| 4,129,762 | | 12/1978 | Bruchet . |
| 4,144,513 | | 3/1979 | Shafer et al. . |
| 4,158,119 | | 6/1979 | Krakik . |
| 4,165,453 | | 8/1979 | Hennemann . |
| 4,166,988 | | 9/1979 | Ciarcia et al. . |
| 4,220,934 | | 9/1980 | Wafer et al. . |
| 4,255,732 | | 3/1981 | Wafer et al. . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |

(List continued on next page.)

*Primary Examiner*—Lincoln Donovan
*Assistant Examiner*—Tuyen T. Nguyen
(74) *Attorney, Agent, or Firm*—Cantor Colburn LLP; Carl B. Horton

(57) ABSTRACT

A thermal trip unit within a multi-pole circuit breaker includes a bimetal element having an off-set end to provide cam function during the calibration of the bimetal element. A calibration screw is threadingly engaged within the bimetal element and is adjusted at various calibration levels by means of a step motor driver element.

16 Claims, 3 Drawing Sheets

U.S. PATENT DOCUMENTS

| | | | |
|---|---|---|---|
| 4,259,651 | | 3/1981 | Yamat . |
| 4,263,492 | | 4/1981 | Maier et al. . |
| 4,276,527 | | 6/1981 | Gerbert-Gaillard et al. . |
| 4,297,663 | | 10/1981 | Seymour et al. . |
| 4,301,342 | | 11/1981 | Castonguay et al. . |
| 4,360,852 | | 11/1982 | Gilmore . |
| 4,368,444 | | 1/1983 | Preuss et al. . |
| 4,375,021 | | 2/1983 | Pardini et al. . |
| 4,375,022 | | 2/1983 | Daussin et al. . |
| 4,376,270 | | 3/1983 | Staffen . |
| 4,383,146 | | 5/1983 | Bur . |
| 4,392,036 | | 7/1983 | Troebel et al. . |
| 4,393,283 | | 7/1983 | Masuda . |
| 4,401,872 | | 8/1983 | Boichot-Castagne et al. . |
| 4,409,573 | | 10/1983 | DiMarco et al. . |
| 4,435,690 | | 3/1984 | Link et al. . |
| 4,467,297 | | 8/1984 | Boichot-Castagne et al. . |
| 4,468,645 | | 8/1984 | Gerbert-Gaillard et al. . |
| 4,470,027 | | 9/1984 | Link et al. . |
| 4,479,143 | | 10/1984 | Watanabe et al. . |
| 4,488,133 | | 12/1984 | McClellan et al. . |
| 4,492,941 | | 1/1985 | Nagel . |
| 4,541,032 | | 9/1985 | Schwab . |
| 4,546,224 | | 10/1985 | Mostosi . |
| 4,550,360 | | 10/1985 | Dougherty . |
| 4,562,419 | | 12/1985 | Preuss et al. . |
| 4,589,052 | | 5/1986 | Dougherty . |
| 4,595,812 | | 6/1986 | Tamaru et al. . |
| 4,603,312 | * | 7/1986 | Conner ..... 335/42 |
| 4,611,187 | | 9/1986 | Banfi . |
| 4,612,430 | | 9/1986 | Sloan et al. . |
| 4,616,198 | | 10/1986 | Pardini . |
| 4,622,444 | | 11/1986 | Kandatsu et al. . |
| 4,631,625 | | 12/1986 | Alexander et al. . |
| 4,642,431 | | 2/1987 | Tedesco et al. . |
| 4,644,438 | | 2/1987 | Puccinelli et al. . |
| 4,649,247 | | 3/1987 | Preuss et al. . |
| 4,658,322 | | 4/1987 | Rivera . |
| 4,672,501 | | 6/1987 | Bilac et al. . |
| 4,675,481 | | 6/1987 | Markowski et al. . |
| 4,682,264 | | 7/1987 | Demeyer . |
| 4,689,712 | | 8/1987 | Demeyer . |
| 4,694,373 | | 9/1987 | Demeyer . |
| 4,710,845 | | 12/1987 | Demeyer . |
| 4,717,985 | | 1/1988 | Demeyer . |
| 4,733,211 | | 3/1988 | Castonguay et al. . |
| 4,733,321 | | 3/1988 | Lindeperg . |
| 4,764,650 | | 8/1988 | Bur et al. . |
| 4,768,007 | | 8/1988 | Mertz et al. . |
| 4,780,786 | | 10/1988 | Weynachter et al. . |
| 4,831,221 | | 5/1989 | Yu et al. . |
| 4,870,531 | | 9/1989 | Danek . |
| 4,883,931 | | 11/1989 | Batteux et al. . |
| 4,884,047 | | 11/1989 | Baginski et al. . |
| 4,884,164 | | 11/1989 | Dziura et al. . |
| 4,900,882 | | 2/1990 | Bernard et al. . |
| 4,910,485 | | 3/1990 | Bolongeat-Mobleu et al. . |
| 4,914,541 | | 4/1990 | Tripodi et al. . |
| 4,916,420 | | 4/1990 | Bartolo et al. . |
| 4,916,421 | | 4/1990 | Pardini et al. . |
| 4,926,282 | | 5/1990 | McGhie . |
| 4,935,590 | | 6/1990 | Malkin et al. . |
| 4,937,706 | | 6/1990 | Schueller et al. . |
| 4,939,492 | | 7/1990 | Raso et al. . |
| 4,943,691 | | 7/1990 | Mertz et al. . |
| 4,943,888 | | 7/1990 | Jacob et al. . |
| 4,950,855 | | 8/1990 | Bolonegeat-Mobleu et al. . |
| 4,951,019 | | 8/1990 | Gula . |
| 4,952,897 | | 8/1990 | Barnel et al. . |
| 4,958,135 | | 9/1990 | Baginski et al. . |
| 4,965,543 | | 10/1990 | Batteux . |
| 4,983,788 | | 1/1991 | Pardini . |
| 5,001,313 | | 3/1991 | Leclerq et al. . |
| 5,004,878 | | 4/1991 | Seymour et al. . |
| 5,029,301 | | 7/1991 | Nebon et al. . |
| 5,030,804 | | 7/1991 | Abri . |
| 5,057,655 | | 10/1991 | Kersusan et al. . |
| 5,077,627 | | 12/1991 | Fraisse . |
| 5,083,081 | | 1/1992 | Barrault et al. . |
| 5,095,183 | | 3/1992 | Raphard et al. . |
| 5,103,198 | | 4/1992 | Morel et al. . |
| 5,115,371 | | 5/1992 | Tripodi . |
| 5,120,921 | | 6/1992 | DiMarco et al. . |
| 5,132,865 | | 7/1992 | Mertz et al. . |
| 5,138,121 | | 8/1992 | Streich et al. . |
| 5,140,115 | | 8/1992 | Morris . |
| 5,153,802 | | 10/1992 | Mertz et al. . |
| 5,155,315 | | 10/1992 | Malkin et al. . |
| 5,166,483 | | 11/1992 | Kersusan et al. . |
| 5,172,087 | | 12/1992 | Castonguay et al. . |
| 5,178,504 | | 1/1993 | Falchi . |
| 5,184,717 | | 2/1993 | Chou et al. . |
| 5,187,339 | | 2/1993 | Lissandrin . |
| 5,198,956 | | 3/1993 | Dvorak . |
| 5,200,724 | | 4/1993 | Gula et al. . |
| 5,210,385 | | 5/1993 | Morel et al. . |
| 5,239,150 | | 8/1993 | Bolongeat-Mobleu et al. . |
| 5,260,533 | | 11/1993 | Livesey et al. . |
| 5,262,744 | | 11/1993 | Arnold et al. . |
| 5,280,144 | | 1/1994 | Bolongeat-Mobleu et al. . |
| 5,281,776 | | 1/1994 | Morel et al. . |
| 5,296,660 | | 3/1994 | Morel et al. . |
| 5,296,664 | | 3/1994 | Crookston et al. . |
| 5,298,874 | | 3/1994 | Morel et al. . |
| 5,300,907 | | 4/1994 | Nereau et al. . |
| 5,310,971 | | 5/1994 | Vial et al. . |
| 5,313,180 | | 5/1994 | Vial et al. . |
| 5,317,471 | * | 5/1994 | Izoard et al. ..... 361/105 |
| 5,331,500 | | 7/1994 | Corcoles et al. . |
| 5,334,808 | | 8/1994 | Bur et al. . |
| 5,341,191 | | 8/1994 | Crookston et al. . |
| 5,347,096 | | 9/1994 | Bolongeat-Mobleu et al. . |
| 5,347,097 | | 9/1994 | Bolongeat-Mobleu et al. . |
| 5,350,892 | | 9/1994 | Rozier . |
| 5,357,066 | | 10/1994 | Morel et al. . |
| 5,357,068 | | 10/1994 | Rozier . |
| 5,357,394 | | 10/1994 | Piney . |
| 5,361,052 | | 11/1994 | Ferullo et al. . |
| 5,373,130 | | 12/1994 | Barrault et al. . |
| 5,379,013 | | 1/1995 | Coudert . |
| 5,424,701 | | 6/1995 | Castonguary et al. . |
| 5,438,176 | | 8/1995 | Bonnardel et al. . |
| 5,440,088 | | 8/1995 | Coudert et al. . |
| 5,449,871 | | 9/1995 | Batteux et al. . |
| 5,450,048 | | 9/1995 | Leger et al. . |
| 5,451,729 | | 9/1995 | Onderka et al. . |
| 5,457,295 | | 10/1995 | Tanibe et al. . |
| 5,467,069 | | 11/1995 | Payet-Burin et al. . |
| 5,469,121 | | 11/1995 | Payet-Burin . |
| 5,475,558 | | 12/1995 | Barjonnet et al. . |
| 5,477,016 | | 12/1995 | Baginski et al. . |
| 5,479,143 | | 12/1995 | Payet-Burin . |
| 5,483,212 | | 1/1996 | Lankuttis et al. . |
| 5,485,343 | | 1/1996 | Santos et al. . |
| 5,493,083 | | 2/1996 | Olivier . |
| 5,504,284 | | 4/1996 | Lazareth et al. . |
| 5,504,290 | | 4/1996 | Baginski et al. . |
| 5,510,761 | | 4/1996 | Boder et al. . |
| 5,512,720 | | 4/1996 | Coudert et al. . |
| 5,515,018 | | 5/1996 | DiMarco et al. . |
| 5,519,561 | | 5/1996 | Mrenna et al. . |

| | | |
|---|---|---|
| 5,534,674 | 7/1996 | Steffens . |
| 5,534,832 | 7/1996 | Duchemin et al. . |
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

METHOD AND ARRANGEMENT FOR CALIBRATION OF CIRCUIT BREAKER THERMAL TRIP UNIT

BACKGROUND OF THE INVENTION

The present invention relates to circuit breaker thermal trip units, and, more particular, to a method and arrangement for calibration of circuit breaker thermal trip units.

In circuit breakers thermal trip units the bimetal elements deform, upon reaching a predetermined temperature, into contact with the circuit breaker trip bar to interrupt circuit current. An early teaching of one such bimetal trip unit for residential type circuit breakers is found in U.S. Pat. No. 3,908,110 entitled Method of Calibrating an Electric Circuit Breaker, wherein lasers and the like are used to calibrate the bimetal during manufacture. U.S. Pat. No. 5,317,471 entitled Process and Device for Setting a Thermal Trip Device, describes the use of lasers for calibrating bimetal trip units within industrial rated circuit breakers in accordance with European Industry Standards.

Further, U.S. Pat. No. 4,616,198 entitled Contact Arrangement for a Current Limiting Circuit Breaker, describes the use of a first and second pair of circuit breaker contacts arranged in series to reduce the amount of current let-through upon the occurrence of an overcurrent condition. U.S. patent application Ser. No. 09/087,038, filed May 29, 1998, entitled Rotary Contact Assembly for High Ampere-Rated Circuit Breakers, describes the operation of the circuit breaker trip unit to release the circuit breaker operating mechanism and separate the circuit breaker contacts.

When rotary operating mechanisms are used to control the circuit breaker contacts, such as described in the aforementioned U.S. Pat. No. 4,616,198 it is imperative that the trip units within each pole of the multi-pole circuit breaker open simultaneously to insure current limiting function within each one of the separate poles, as well as to avoid the occurrence of so-called "single phasing" whereby one of the phases interrupts independently of the remaining phases causing increased current transport through the remaining phases. Certain U.S. Federal and state electric codes require individual calibration of the bimetal trip units within each separate pole to insure simultaneous circuit interruption within each of the poles upon occurrence of an overcurrent condition in any one of the individual poles.

With the use of automatic bimetal calibration devices, as described in the aforementioned U.S. Pat. No. 3,908,110, for example, care is taken to insure that the bimetal element, per se, is electrically-insulated from the screws or pins use in calibrating the position of the bimetal element from the operating mechanism trip bar. The imposition of an electrically-insulative sleeve or the like between the bimetal and calibration screw increases both the installation and calibration expense at the time of manufacture.

SUMMARY OF THE INVENTION

In an exemplary embodiment of the invention, a thermal trip unit within a circuit breaker includes a bimetal element having an off-set end to provide cam function during the calibration of the bimetal element. The calibration screw is threadingly engaged within the bimetal and is adjusted at various calibration levels by means of a servo-drive or servo motor driver element. The circuit breaker operating mechanism trip bar configured to insure that the circuit breaker operating mechanism responds to simultaneous interruption of circuit current through each of the poles upon occurrence of an overcurrent condition through any one of the individual poles.

DESCRIPTION OF THE PREFERRED EMBODIMENT

Figure 1:
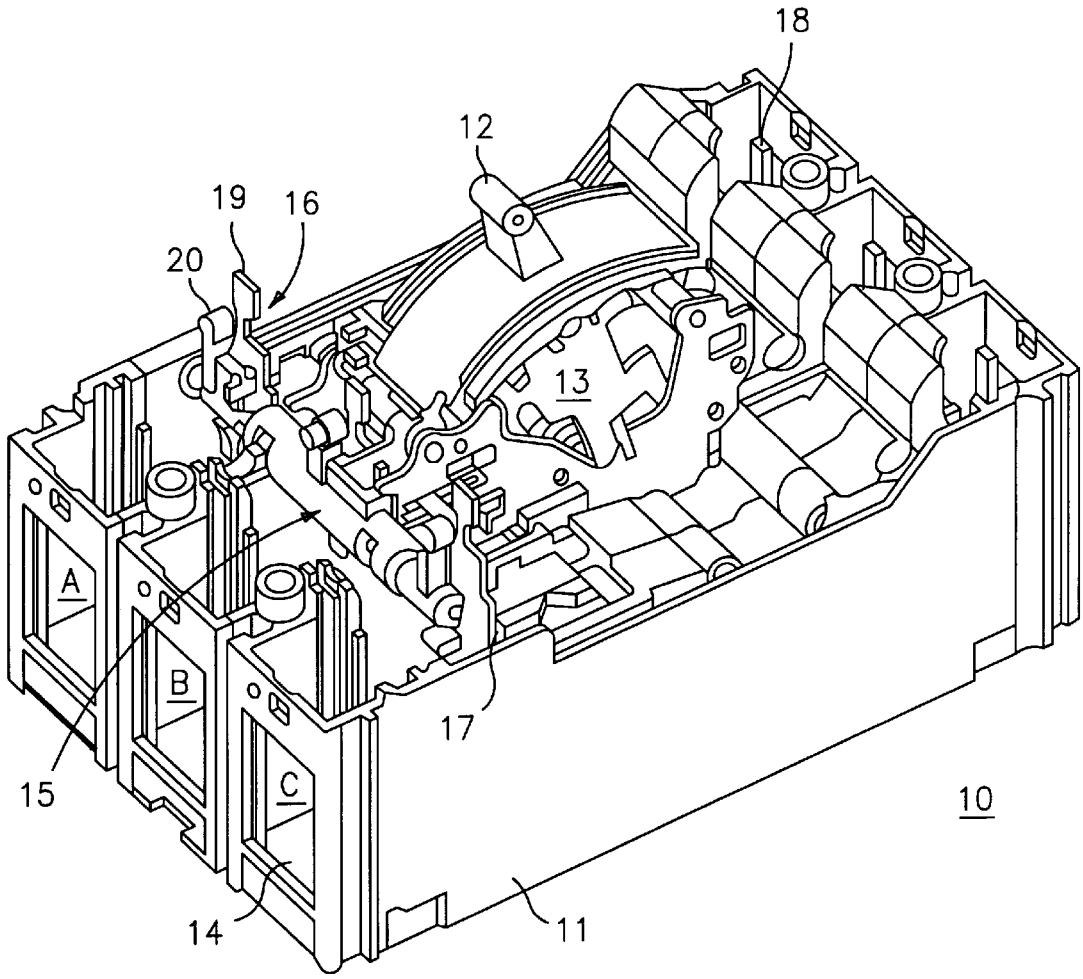
FIG. 1 is a top perspective view of a multi-pole circuit breaker containing the thermal trip unit in accordance with the invention.
Figure 3:
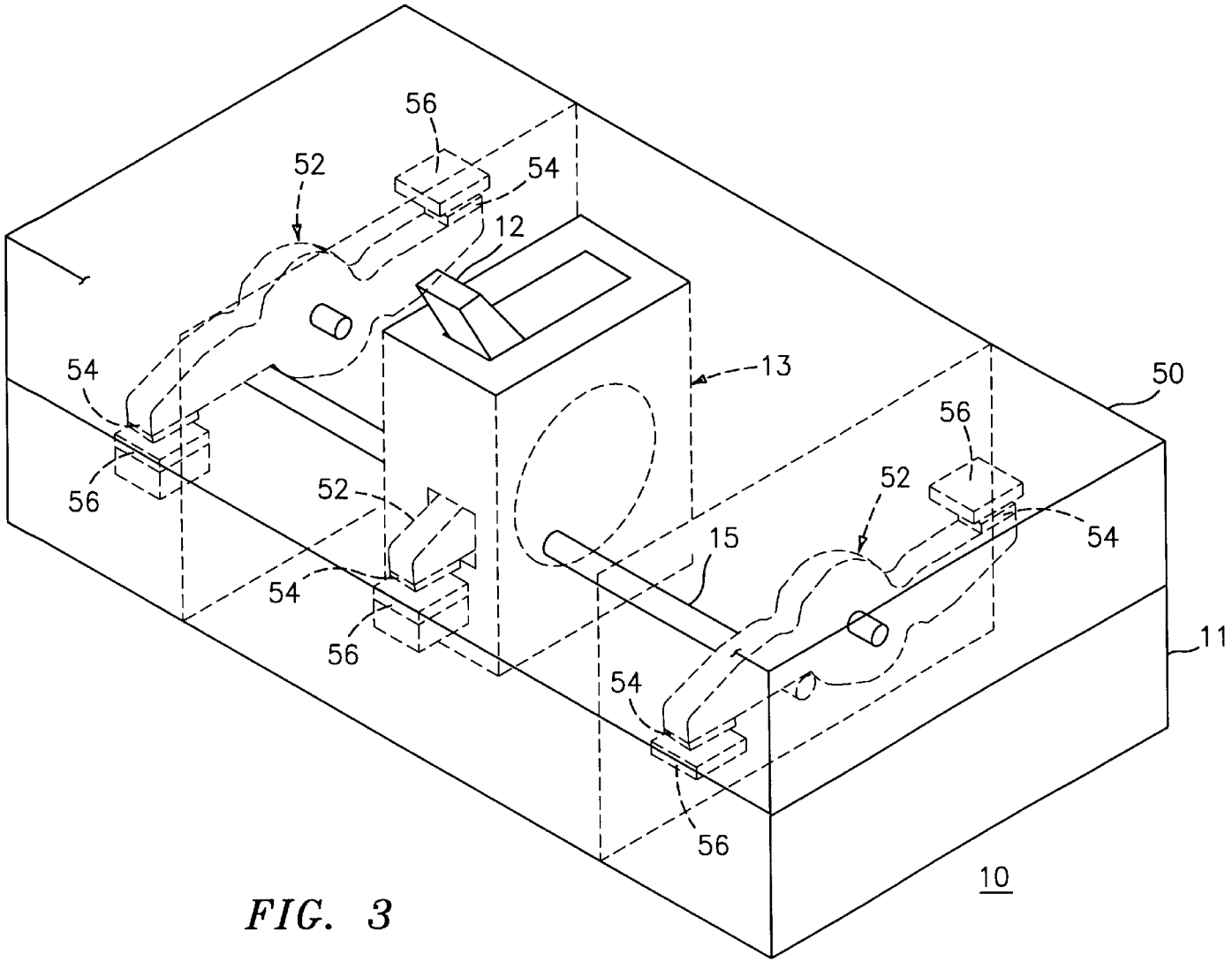

Referring to FIG. 1, an industrial-rated three pole circuit breaker is shown at 10 with a cover 50 (shown in FIG. 3) omitted from a case 11 to depict the interior thereof. A circuit breaker operating handle 12 manually rotates an operating mechanism 13 to move the circuit breaker contacts (not shown) between ON and OFF positions. Electrical connection with a protected electric circuit is made by means of load straps 14 on one end of case 11 and line straps (not shown) on the opposite side of case 11. Operating mechanism 13 interacts with the circuit breaker contacts within the separate circuit breaker poles A–C by means of a cross bar 15 in the manner described within the aforementioned U.S. patent application Ser. No. 09/087,038, filed May 29, 1998, entitled Rotary Contact Assembly for High Ampere-Rated Circuit Breakers, which is incorporated herein by reference. As shown in FIG. 3, each pole of the circuit breaker 10 includes a rotary contact arm 52 holding a movable contact 54 on each end of the arm 52. Each movable contact 54 is aligned for abutting or separating from a stationary or fixed contact 56 which is attached to either a load strap or a line strap. According to an exemplary embodiment of the present invention, a thermal trip unit 16 within each trip unit compartment 17 interacts with a top lever 20 on crossbar 15 by means of a bimetal 19 upon occurrence of an overcurrent condition of predetermined values.

Figure 2:
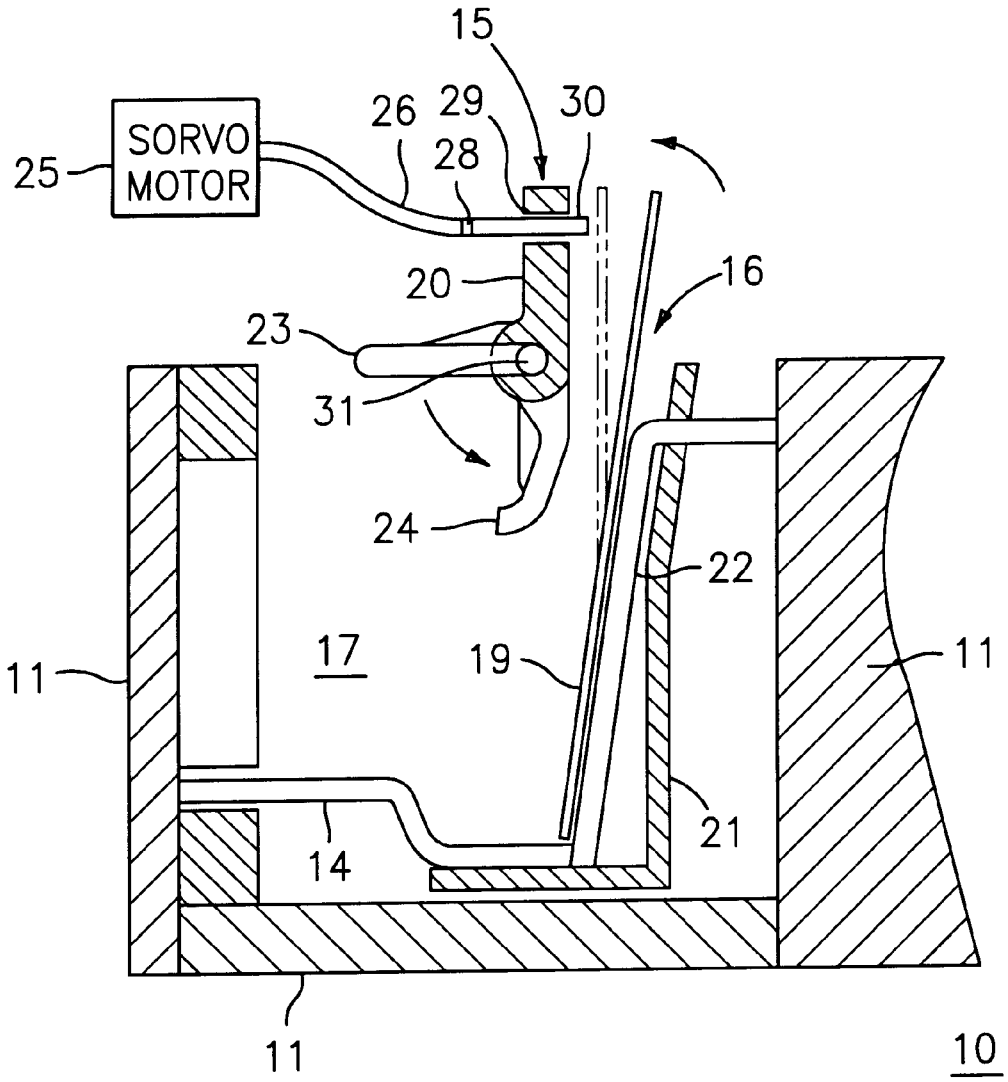
FIG. 2 is a side view of the circuit breaker of FIG. 1 in partial section depicting the thermal trip unit installed within one of the trip unit compartments; and, FIG. 3 is a top perspective view of a circuit breaker employing a rotary contact assembly.

To insure operation of bimetal 19 within thermal trip unit 16, the bimetal is calibrated in the manner best seen by referring now to FIG. 2. Although only one trip unit 16 is shown within a single compartment 17 in case 11, the trip units within all three poles are calibrated and tested in a similar manner. A heater 22 connects with load strap 14 and is attached to bimetal 19 to insure good thermal relation between the heater and the bimetal for test and operational purposes. As indicated, the bottom of the bimetal and heater are separated from the case by means of an insulative plate 21. The crossbar 15 is pivotally arranged within the case by means of a crossbar pivot 31 to provide rotation in the clockwise indicated direction upon contact between the top of bimetal 19 and a calibration screw 30 extending within a threaded aperture 29 formed within the top lever 20 of crossbar 15. Bottom levers 23, 24 on the crossbar, interact with the operating mechanism to release the circuit breaker operating springs (not shown) and separate the contacts (shown in FIG. 3) in the manner described in the aforementioned U.S. patent application Ser. No. 09/087,038, entitled Rotary Contact Assembly for High Ampere-Rated Circuit Breakers.

Precise calibration of the bimetal for so-called "long time" circuit interruption is achieved in the following manner. In the latter stages of the manufacturing process, when the circuit breaker operating components are fixed within the circuit breaker case 11, the bimetal 19 can be calibrated with high tolerance. A servo-motor 25, e.g., a type GRMTR servo-motor obtained from Pitman Co., is operatively connected with the slotted end 28 of the calibration screw 30 by means of the driver arm 26. The servo-motor is programmed in feed-back relation with bimetal 19 by virtue of the electrical signal transfer between the bimetal and the calibration screw for extremely fast servo-motor response.

In the first stage of calibration, heater 22 is supplied with 200 to 400 percent rated circuit breaker current for a predetermined period of time causing the bimetal to deflect to the position indicated in phantom. After the time period has expired, the current is reduced to 100 percent rated circuit breaker current to allow bimetal 19 to remain in the deflected position. At the same time, the servo-motor driver arm 26 begins rotation of the calibration screw and continues such rotation until the end of the calibration screw 30 contacts the bimetal, at which time an electric circuit with the servo-motor controller is completed causing the servo-motor to immediately cease rotation of the driver arm allowing the calibration screw to remain fixed within the threaded aperture 29 formed within the top lever 20 of the crossbar 15. The first stage of calibration is performed within the remaining poles to insure exact positioning of the calibration screw relative to the bimetal within each pole.

In the second stage of calibration, the a test current of 300 percent circuit breaker rated current is applied to heater 22 in each separate pole and the time for bimetal 19 to deflect into contact with the calibration screw 30 is electrically determined. If the time taken for contact between the calibration screw 30 and bimetal 19 is less than the predetermined time, the servo-motor rotates the driver arm and the calibration screw in the counterclockwise direction to compensate for the required time increment. It is believed that the use of electric circuit between the bimetal, calibration screw and the servo-motor controller represents a substantial improvement over earlier techniques that include the combination of lasers, pyrometers and the like to determine temperature in the calibration process.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A thermal trip unit for electric circuit breakers comprising:

a strap arranged for connection with an electric circuit;

a trip bar assembly rotatably mounted about a pivot above said strap;

a bimetal element having a first end and a second end, said bimetal element electrically connected with said strap at said first end and arranged for striking said trip bar assembly at said second end;

a calibration device having a first end and a second end, said calibration device extending through said trip bar assembly, the second end of said calibration device for contacting said second end of said bimetal element;

a heater element electrically connecting with said bimetal element and said strap at one end and a circuit breaker contact carrier at an opposite end, said second end of said bimetal element movable towards said second end of said calibration device upon current transfer through said heater element; and, a drive connected to the first end of said calibration device for automatically moving said calibration device into contact with said second end of said bimetal element when said current transfer through said heater element exceeds a predetermined value.

2. The thermal trip unit of claim 1 including:

a trip lever extending from a bottom of said trip bar assembly, said trip lever arranged for rotation about said pivot when said current transfer through said heater element exceeds a predetermined value.

3. The thermal trip unit of claim 1 wherein said drive comprises a servo-drive or servo motor assembly.

4. A circuit breaker comprising:

an electrically-insulative case attached to an electrically-insulative cover;

a pair of separable contacts within said case;

a thermal trip unit within said case, said thermal trip unit comprising a strap arranged for connection with an electric circuit;

a trip bar assembly rotatably mounted about a pivot above said strap;

a bimetal element having a first end and a second end, said bimetal element electrically connected with said strap at said first end and arranged for striking said trip bar assembly at said second end;

a calibration device having a first end and a second end, said calibration device extending through said trip bar assembly, said second end of said calibration device for contacting said second end of said bimetal element;

a heater element electrically connecting with said bimetal element and said strap at one end and a circuit breaker contact carrier at an opposite end, said second end of said bimetal element movable towards an end of said calibration device upon current transfer through said heater element; and, a drive connected to the first end of said calibration device for automatically moving said second end of said calibration device into contact with said second end of said bimetal element when said current transfer through said heater element exceeds a predetermined value.

5. The circuit breaker of claim 4 including:

a trip lever extending from a bottom of said trip bar assembly, said trip lever arranged for rotation about said pivot when said current transfer through said heater element exceeds a predetermined value.

6. The circuit breaker of claim 4 wherein said drive comprises a servo-drive or servo motor assembly.

7. A method for calibrating a circuit breaker thermal trip unit comprising:

providing a bimetal element having a first end and a second end;

interfacing said bimetal element between a rotatably-mounted trip bar assembly and a heater element, said trip bar assembly having a calibration screw extending therethrough;

supplying electric current to said heater element for a predetermined period of time to cause said second end of said bimetal element to move toward said calibration screw;

attaching an automatic drive unit to a first end of said calibration screw;

rotating said calibration screw with said automatic drive unit, causing a second end of said calibration screw to contact said second end of said bimetal element; and, completing an electric circuit between the bimetal, calibration screw, and the automatic drive unit.

8. The method of claim 7 wherein attaching an automatic drive unit includes using a servo-drive or servo motor assembly for rotation of said calibration screw.

9. The method of claim 7 further comprising programming the automatic drive unit in feedback relation with the bimetal element.

10. The method of claim 7 wherein supplying electric current to said heater element includes supplying said heater element with a test current of 200 to 400 percent rated circuit breaker current for a predetermined period of time and then reducing the current to 100 percent rated circuit breaker current.

11. The method of claim 7 further comprising ceasing rotation of said calibration screw when said second end of said calibration screw contacts said second end of said bimetal element.

12. The method of claim 11 further comprising removing the electric current to said heater element subsequent ceasing rotation of said calibration screw.

13. The method of claim 12 further comprising, subsequent removing the electric current, resupplying an electric current to said heater element, measuring a second time period for the bimetal element to contact the second end of said calibration screw, and comparing the second time period to the predetermined period of time.

14. The method of claim 13 further comprising, subsequent comparing the second time period to the predetermined period of time, using the automatic drive unit to rotate the calibration screw in a counterclockwise direction if the second time period is less than the predetermined period of time.

15. The thermal trip unit of claim 1 wherein the drive is programmed in feed-back relation with the bimetal element.

16. The circuit breaker of claim 4 wherein the drive is programmed in feed-back relation with the bimetal element.

* * * * *